US006235346B1

(12) United States Patent
Barnisin, Jr.

(10) Patent No.: US 6,235,346 B1
(45) Date of Patent: May 22, 2001

(54) METHOD FOR PRESSURE TREATING WOOD

(75) Inventor: Michael A. Barnisin, Jr., Gilbertsville, PA (US)

(73) Assignee: Coating Development Group, Inc., Philadelphia, PA (US)

( * ) Notice: Subject to any disclaimer, the term of this patent is extended or adjusted under 35 U.S.C. 154(b) by 0 days.

(21) Appl. No.: 09/334,881

(22) Filed: Jun. 17, 1999

Related U.S. Application Data

(60) Provisional application No. 60/089,545, filed on Jun. 17, 1998.

(51) Int. Cl.[7] ..... B05D 1/38; B05D 3/02; B05D 3/12; B05D 7/06

(52) U.S. Cl. ..... 427/297; 427/351; 427/393; 427/397; 427/408; 427/416

(58) Field of Search ..... 427/297, 351, 427/369, 370, 393, 397, 408, 416

(56) References Cited

U.S. PATENT DOCUMENTS

| | | | | |
|---|---|---|---|---|
| 3,061,508 | | 10/1962 | Morriss, Jr. et al. | 167/42 |
| 4,085,251 | | 4/1978 | Rak | 428/485 |
| 4,590,208 | | 5/1986 | Hilditch et al. | 514/500 |
| 4,656,060 | | 4/1987 | Krzyzewski | 427/397 |
| 4,678,715 | * | 7/1987 | Giebeler et al. | 427/297 |
| 4,786,326 | | 11/1988 | Grove | 106/15.05 |
| 4,971,840 | | 11/1990 | Bohó et al. | 427/397 |
| 4,977,186 | | 12/1990 | Gruening | 514/479 |
| 5,186,947 | | 2/1993 | Goettsche et al. | 424/638 |
| 5,635,217 | | 6/1997 | Goettsche et al. | 424/634 |

FOREIGN PATENT DOCUMENTS 1-182002 * 7/1989 (JP) .

* cited by examiner

*Primary Examiner*—Erma Cameron
(74) *Attorney, Agent, or Firm*—Robert S. Lipton, Esq.; Lipton, Weinberger & Husick

(57) ABSTRACT

The present invention is a process for pressure treating wood and includes wood which has been pressure treated by the process. The process comprises infusion into the wood of a solution in water of an anhydride or the analogous acid of an anhydride, followed by removal of moisture from the wood and the infusion of the wood with a molten waxy solid comprising hydrocarbon paraffins or saturated fatty acids. The molten waxy solid then solidifies, filling all voids in the wood.

5 Claims, 1 Drawing Sheet

METHOD FOR PRESSURE TREATING WOOD

CROSS-REFERENCE TO RELATED APPLICATIONS

This application claims the benefit of U.S. Provisional Application No. 60/089,545 filed Jun. 17, 1998 entitled Method for Pressure Treating Wood.

FIELD OF THE INVENTION

The invention relates to a method for the pressure treatment of wood and to wood treated by the disclosed method. In the pressure treatment of wood, various active ingredients such as fungicides or other wood preservatives are impregnated deeply into wood through the application of pressure. A well known example of such pressure treated wood is wood intended for outdoor use in fences or decks and impregnated with preservatives to prevent deterioration of the wood through the action of the elements or from insects or microbes.

BACKGROUND OF THE INVENTION

Although there are various pressure treatment methods for impregnating wood with active ingredients, the Bethel process is one of the better known. In the Bethel process, wood is dried so that its moisture content is substantially reduced. The wood is placed in a vacuum chamber to draw air from the wood. A mixture of water and active ingredients is then injected into the chamber under pressure. Pressures up to 250 pounds per square inch (psi) can be applied. The pressure is removed so that the wood is again subject to atmospheric pressure. The wood then is transferred to a kiln and dried to reduce the moisture content thereby leaving the active ingredient infused and imbedded in the wood.

The prior art of pressure treatment of wood has proven unsatisfactory in several respects. Most pressure treated wood is used outdoors and is exposed frequently to water, which is able to seep into the prior art pressure treated wood. The movement of water in and out of the wood causes two things to occur. First, the water dissolves any water soluble active ingredients and extracts those ingredients from the wood, thereby reducing the beneficial properties the ingredients may have imparted, such as rot prevention or flame retardance. Second, the water causes dimensional instability of the wood, which can take the form of splitting and cracking upon freezing.

An effective active ingredient commonly used for the pressure treatment of wood is Copper Chrome Arsenate (CCA), a heavy metal. The possibility of leaching has caused some persons to criticize the use of CCA.

The problem of leaching of active ingredients from pressure treated wood is recognized in the prior art, and attempts have been made to address the problem. One prior art attempt at a solution is to use polymeric binders to secure particles of an active ingredient to the wood. These polymeric binders typically use aminoplast curing agents that have the undesirable characteristic of generating formaldehyde. Formaldehyde has various undesirable characteristics, such as generating odors. Formaldehyde also is a suspected carcinogen.

SUMMARY OF THE INVENTION

It is an object of the present invention to provide a method for pressure treating wood wherein the active ingredients are secured within and to the wood so that the active ingredients cannot leach from the wood and thereby decrease the active life of the pressure treatment. It is a further object of the invention to provide pressure treated wood within which and to which active ingredients are secured so that the active ingredients may not leach from the wood. It is a further object of the invention to improve the dimensional stability of pressure treated wood to reduce maintenance and to increase the service life of the wood. It is a further object of the invention to provide a machined treated wood by-product for use in particle board or oriented strand board to impart the beneficial properties of the pressure treated wood to the particle board and to the strand board.

These objectives are accomplished and the deficiencies of the prior art rectified by infusing or injecting into wood a reactive solid in a water solution using familiar pressure treatment techniques. The reactive solid comprises a chemical compound selected from the class comprising anhydrides and the analogous acids of anhydrides. The reactive solid solution may include active ingredients such as fungicides, mildewcides, bactericides, flame retardants, colorants, and water repellants.

The reactive solid reacts with and forms chemical bonds to and within the cellulosic structure of the wood. The wood treated with the reactive solid has improved dimensional stability and resistance to swelling on contact with water. In tests on southern yellow pine, infusion with anhydrides reduced swelling due to absorption of water to less than three percent.

The objectives of the present invention may be further accomplished by infusing or injecting into the wood a waxy solid having a melting point above the temperature to which the wood will be exposed in use. Suitable waxy solids comprise paraffinic hydrocarbons or a saturated fatty acid. Infusion or injection of the waxy solid is accomplished by heating the waxy solid and the wood to a temperature above the melting point of the waxy solid and then using familiar pressure treatment techniques to infuse the waxy solid into the wood. The waxy solid may be mixed with an active ingredient. The waxy solid solidifies in the wood, forming a barrier to water and preventing leaching of the active ingredients.

The finished wood product differs from other solid-filled wood products such as the wood-polymer composites in that no sensitizing or dangerous ingredients such as acrylated monomers and peroxide or Vaso catalysts typically associated with this type of product are used.

Wood may be pressure treated by infusion either with the reactive solid solution or with the waxy solid. Best results are obtained by using both techniques and by first infusing the wood with the reactive solid solution followed by infusion with the waxy solid.

DETAILED DESCRIPTION

In describing a preferred embodiment of the invention, specific terminology will be selected for the sake of clarity. However, the invention is not intended to be limited to the specific terms so selected, and it is to be understood that each specific term includes all technical equivalents that operate in a similar manner to accomplish a similar purpose.

Figure 1:
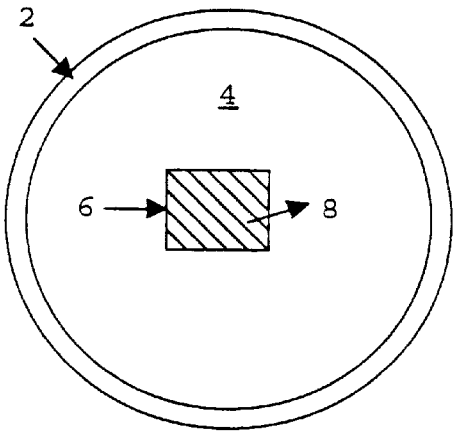
FIG. 1 shows removal of air from the wood to be treated in a vacuum chamber.

In the preferred embodiment and as illustrated in FIG. 1, kiln-dried wood 6 with a moisture content of less than 20% and preferably less than 10% is placed in a vacuum chamber 2. Air 4 is evacuated from the vacuum chamber 2 to remove air 8 from the wood 6.

Figure 2:
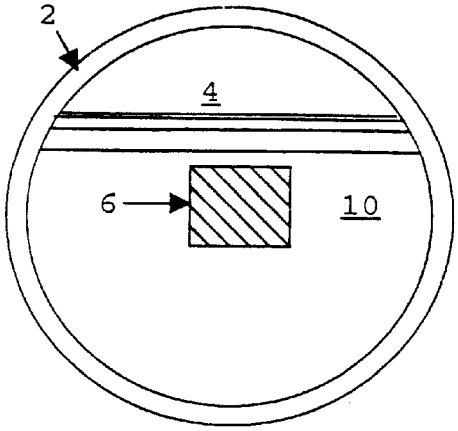
FIG. 2 shows injection of a reactive solid in solution into the vacuum chamber and application of pressure to saturate the wood.

As shown by FIG. 2, a solution of a reactive solid and water 10 is introduced into the evacuated vacuum chamber 2. The reactive solid comprises an anhydride. In the preferred embodiment, the anhydride is maleic anhydride, phthalic anhydride, or a mixture of the two at a ratio of six parts maleic anhydride to one part of phthalic anhydride (although a range of one to twenty-five parts maleic anhydride to one part phthalic anhydride may be used for specific applications). The analogous acid which would result from hydration of an anhydride may be substituted for the anhydride in the solution.

One or more active ingredients may be mixed with the anhydride solution. Because the solution is water based, the active ingredients must be water soluble, water dispersed or emulsified. In the preferred embodiment, the active ingredient is boric acid.

In the preferred embodiment, the reactive anhydride comprises up to twenty-five percent by weight of the reactive anhydride solution, boric acid comprises up to three percent of the solution by weight and water comprises the balance of the solution. Certain Lewis acids; namely $SnCI_4$, may be added as co-promoters.

As shown by FIG. 2, air 4 is pressurized within the vacuum chamber 2, thereby infusing the reactive solid solution 10 into the wood 6. In the preferred embodiment, pressure of the air 4 may be increased up to 250 psi.

Figure 3:
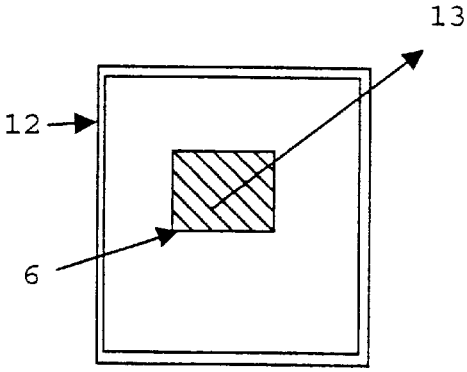
FIG. 3 shows the wood removed from the vacuum chamber and heated in a kiln to remove excess moisture.

Wood 6 is removed from the vacuum chamber 2, shown in FIG. 2, and is placed in a kiln 12, as shown by FIG. 3. The temperature of the wood 6 is raised in the kiln to remove excess moisture 13. In the preferred embodiment, the wood is heated and dried for about 24 to 48 hours at a range of temperatures between approximately 170–190 degrees F.

Figure 4:
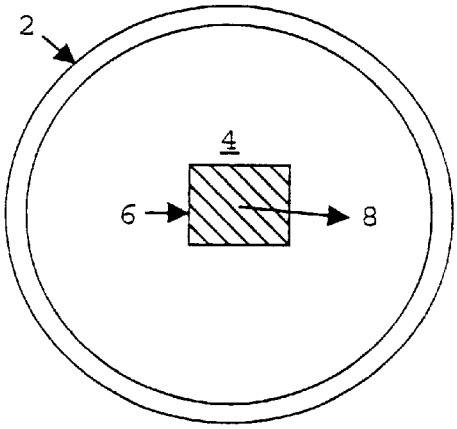
FIG. 4 shows the wood again placed in a vacuum chamber and air removed from the wood.
Figure 5:
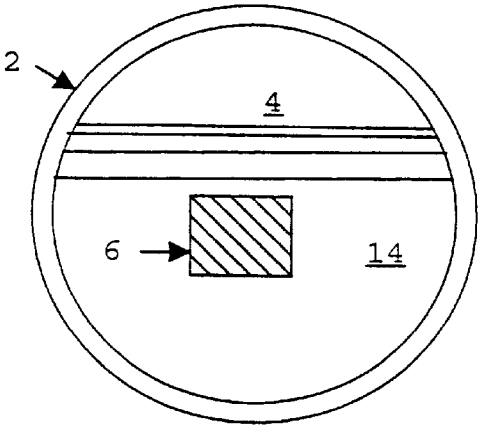
FIG. 5 shows injection of molten waxy solid into the vacuum chamber and application of pressure to saturate the wood.

As shown by FIG. 4, the heated wood 6 then is placed in a vacuum chamber 2 and air 4 is evacuated from the chamber to remove air 8 from the wood 6. One or more molten waxy solids 14, FIG. 5, is introduced into the evacuated vacuum chamber 2, and the air 4 within the vacuum chamber is pressurized thereby infusing the waxy solid into the wood. In the preferred embodiment, the pressure may be increased by up to 250 psi.

The waxy solid 14, FIG. 5, comprises paraffinic hydrocarbons, saturated fatty acids or a mixture of the two. The waxy solid must have a melting point above the maximum temperature to which the wood will be subjected in use. The paraffinic hydrocarbons and saturated fatty acids having this characteristic are well known to those of ordinary skill in the organic chemical arts. Suitable saturated fatty acids include those comprised of twelve carbon chains or higher, their esters, alcohols and transition metal salts. In the preferred embodiment the waxy solid comprises stearic acid (C-18 fatty acid), methyl stearate (ester of C-18 fatty acid), Stearyl alcohol (alcohol of C-18 fatty acid), zinc stearate (zinc salt of C-18 fatty acid), palmitic acid (C-16 fatty acid), myristic acid (C-14 fatty acid), lauric acid (C-12 fatty acid) or paraffin (solid hydrocarbon).

Paraffin is as effective for pressure treatment of wood 6 as the saturated fatty acids. Paraffin has the disadvantage that it is usually derived from petroleum products whereas the fatty acids are derived form renewable resources such as natural oils and fats. It therefore may be more desirable to use the fatty acids.

The waxy solid 14, FIG. 5, may include one or more active ingredients. In the preferred embodiment, the active ingredients are oil soluble and are dissolved in the waxy solid. Suitable oil soluble active ingredients are well known in the wood treatment art.

The step of infusing the waxy solid 14, FIG. 5, into the wood 6 must take place at an elevated temperature to ensure that the waxy solid remains in a liquid state and at low enough viscosity to ensure effective infusion. The temperature depends on the waxy solid selected. For stearic acid, that temperature preferably approximately 160 degrees F. For zinc stearate blended with stearic acid, the temperature preferably is approximately 220 degrees F.

The waxy solid preferably comprises 90% or more of the waxy solid-active ingredient mixture. Preferred embodiments of the waxy solid-active ingredient mixture are listed in Tables 1 through 6 below.

TABLE 1

| Component | Weight % |
|---|---|
| Stearic Acid | 95–100 |
| Active Ingredients | 5–0 |
| | 100 |

TABLE 2

| Component | Weight % |
|---|---|
| Stearic Acid | 85.5–90 |
| Zinc Stearate | 9.5–10 |
| Active Ingredients | 5–0 |
| | 100 |

TABLE 3

| Component | Weight % |
|---|---|
| Palmitic Acid | 95–100 |
| Active Ingredients | 5–0 |
| | 100 |

TABLE 4

| Component | Weight % |
|---|---|
| Myristic Acid | 91–100 |
| Active Ingredients | 9–0 |
| | 100 |

TABLE 5

| Component | Weight % |
|---|---|
| Lauric Acid | 91–100 |
| Active Ingredients | 9–0 |
| | 100 |

TABLE 6

| Component | Weight % |
|---|---|
| Paraffin | 91–100 |
| Active Ingredients | 9–0 |
| | 100 |

In the preferred embodiment, all of the voids of the wood 6, FIG. 5, are filled by infusion with the waxy solids-active ingredient mixture 14. After infusion of the wood 6, the wood 6 is removed from the vacuum chamber 2 and allowed to cool. The waxy solid-active ingredient mixture 14 will solidify to the center of the wood 6. The pressure treated wood 6 is then ready for use.

There are many variations of this process that reduce the process time in the vacuum or kiln or reduce the amount of penetration of the treatment solution, as by application of a partial as opposed to a full vacuum. The alternatives which reduce penetration of the wood decrease manufacturing costs but result in decreased performance by the pressure treated wood.

In the preferred embodiment, wood 6 is infused first with an anhydride solution 10 including active ingredients and subsequently infused with a waxy solid mixture 14 including active ingredients. Beneficial results also can be obtained by infusing the wood 6 only with the anhydride solution 10 or only with the waxy solid mixture 14.

All solutions and mixtures have an indefinite shelf life and can be recycled. All byproducts generated from machining operations of the wood pressure treated with both the anhydride solution and the waxy solid can be used for particle board, oriented strand board or other wood composite products resulting in improved properties.

Although the invention has been described with reference to the preferred embodiments, workers skilled in the art to which the invention pertains will recognize that changes may be made in form and detail without departing from the spirit and scope of the invention.

I claim:

1. A process for treating wood comprising the steps of:

(a) drying the wood to a moisture content below ten percent (10%);

(b) evacuating the air from the wood;

(c) infusing a solution of anhydride and water into the wood;

(d) drying the wood to a moisture content below eight percent (8%);

(e) evacuating the air from the wood again while the wood is still at a high temperature from the step of drying below eight percent (8%) moisture;

(f) infusing a molten waxy solid into the wood; and (g) cooling the wood to room temperature.

2. The process of claim 1 wherein the waxy solid is selected from the group consisting of parafinnic hydrocarbons, saturated fatty acids or a mixture of parafinnic hydrocarbons and saturated fatty acids.

3. The process of claim 1 wherein the wood is infused with a waxy solid at an temperature higher than the melting temperature of the waxy solid to facilitate the penetration of the waxy solid into the wood.

4. The process of claim 1 wherein the infusion of the waxy solid includes the infusion of a solution of waxy solid with an active ingredient.

5. The process of claim 4 wherein the active ingredient is selected from the group consisting of fungicides, mildewicides, bactericides, flame retardants, colorants or water repellents.

* * * * *